US009118138B2

(12) United States Patent
Bianca

(10) Patent No.: US 9,118,138 B2
(45) Date of Patent: Aug. 25, 2015

(54) ELECTRICAL CONNECTOR HAVING RESILIENT LATCHES

(71) Applicant: Tyco Electronics Services GmbH, Schaffhausen (CH)

(72) Inventor: Giuseppe Bianca, Temecula, CA (US)

(73) Assignee: TYCO ELECTRONICS SERVICES GmbH, Schaffhausen (CH)

( * ) Notice: Subject to any disclaimer, the term of this patent is extended or adjusted under 35 U.S.C. 154(b) by 205 days.

(21) Appl. No.: 13/863,987

(22) Filed: Apr. 16, 2013

(65) Prior Publication Data

US 2014/0308846 A1 Oct. 16, 2014

(51) Int. Cl.

| | |
|---|---|
| ***H01R 13/40*** | (2006.01) |
| ***H01R 13/424*** | (2006.01) |
| ***H01R 13/41*** | (2006.01) |
| ***H01R 13/436*** | (2006.01) |
| ***H01R 13/506*** | (2006.01) |
| ***H01R 13/622*** | (2006.01) |
| *H01R 13/52* | (2006.01) |

(52) U.S. Cl.

CPC ..... *H01R 13/424* (2013.01); *H01R 13/41* (2013.01); *H01R 13/4365* (2013.01); *H01R 13/506* (2013.01); *H01R 13/622* (2013.01); *H01R 13/5208* (2013.01)

(58) Field of Classification Search

USPC ..... 439/595, 752, 276, 936

See application file for complete search history.

(56) References Cited

U.S. PATENT DOCUMENTS

| | | | | |
|---|---|---|---|---|
| 4,698,030 | A * | 10/1987 | Ryll et al. | 439/752 |
| 5,496,194 | A * | 3/1996 | Huss, Jr. | 439/595 |
| 5,503,569 | A * | 4/1996 | Huss et al. | 439/595 |
| 5,630,732 | A * | 5/1997 | Yamanashi | 439/589 |
| 6,065,999 | A * | 5/2000 | Radliff | 439/595 |
| 7,922,535 | B1 | 4/2011 | Jiang et al. | |
| 8,419,485 | B2 * | 4/2013 | Stausser et al. | 439/752 |
| 2011/0237124 | A1 | 9/2011 | Flaherty et al. | |
| 2011/0281454 | A1 | 11/2011 | Phillips et al. | |

FOREIGN PATENT DOCUMENTS

| | | |
|---|---|---|
| EP | 2 418 742 A1 | 2/2012 |

OTHER PUBLICATIONS

European Search Report, Mail Date, Jul. 7, 2014, EP 14 16 3675, Application No. 14163675.3-1801.

* cited by examiner

*Primary Examiner* — Tho D Ta

(57) ABSTRACT

An electrical connector includes a shell with a chamber and an insert assembly received in the chamber. The insert assembly has cavities therethrough that are configured to receive contacts. The contacts are configured for electrical connection to mating contacts of a mating connector. The insert assembly has resilient latches extending from an outer periphery of the insert assembly that engage the shell to hold the insert assembly in the chamber.

20 Claims, 3 Drawing Sheets

ELECTRICAL CONNECTOR HAVING RESILIENT LATCHES

BACKGROUND OF THE INVENTION

The subject matter herein relates generally to electrical connectors.

Electrical connectors generally include an insert that houses contacts, and the insert is retained in a shell. Electrical connector assemblies are often used in military and aerospace applications, and are also used in industrial, marine, and automotive applications, among others. The connectors, therefore, must be designed to withstand harsh environments, including extreme temperatures, pressures, physical forces like shock and vibration, corrosive contaminants, radiation, and electromagnetic interference. Therefore, the electrical connectors must be designed and assembled such that the contacts and insert do not become dislodged from the shell during operation in these harsh environments.

Currently, inserts are retained in the shells by adding an additional device to hold the inserts in position. Examples of these additional devices include composite retention clips and metal snap rings. These additional devices are added after the insert is loaded within the shell. Adding a separate snap ring or retention device requires special tooling, stocking of additional part numbers, additional time to add a secondary item, and potential dislodging of the retention mechanism due to improper seating or insertion process variations.

A need remains for an electrical connector that effectively retains an insert assembly within a shell while avoiding the problems associated with conventional electrical connectors.

BRIEF DESCRIPTION OF THE INVENTION

In one embodiment, an electrical connector includes a shell with a chamber and an insert assembly received in the chamber. The insert assembly has cavities therethrough that are configured to receive contacts. The contacts are configured for electrical connection to mating contacts of a mating connector. The insert assembly has resilient latches that extend from an outer periphery of the insert assembly that engage the shell to hold the insert assembly in the chamber.

Optionally, the shell may have a groove along an inner periphery of the shell. The resilient latches may be biased towards being received in the groove. The groove may include multiple pockets positioned along the inner periphery of the shell. Each pocket may be configured to receive at least one resilient latch. Optionally, the resilient latches may be molded and formed integral with the insert assembly. The insert assembly may further include a flange. The shell may include a shoulder along an inner periphery of the shell. The insert assembly may be loaded into the shell in a loading direction until the flange of the insert assembly abuts the shoulder of the shell to prevent additional movement of the insert assembly in the loading direction relative to the shell. Optionally, the insert assembly may further include a front insert, a rear insert, and a grommet. The rear insert may be between the front insert and the grommet. The resilient latches may extend from an outer periphery of the rear insert.

In another embodiment, an electrical connector includes a shell with a chamber and an insert assembly received in the chamber. The insert assembly has a front insert and a rear insert. The front insert and rear insert have cavities therethrough configured to receive contacts. The contacts are configured for electrical connection to mating contacts of a mating connector. The rear insert has resilient latches that extend from an outer periphery of the rear insert that engage the shell to hold the insert assembly in the chamber.

In an example embodiment, an electrical connector assembly includes a first electrical connector and a second electrical connector configured to be mated to the first electrical connector. The first electrical connector and the second electrical connector each have a shell with a chamber and an insert assembly received in the chamber. The insert assembly of the first electrical connector has a front insert bonded to a rear insert. The front and rear inserts have cavities therethrough configured to receive first contacts. The first contacts are configured for electrical connection to second contacts held by the insert assembly of the second electrical connector. The rear insert of the first electrical connector has integrally-molded resilient latches extending from an outer periphery of the rear insert that engage the shell of the first electrical connector to hold the insert assembly of the first electrical connector within the chamber of the shell.

DETAILED DESCRIPTION OF THE INVENTION

Figure 1:
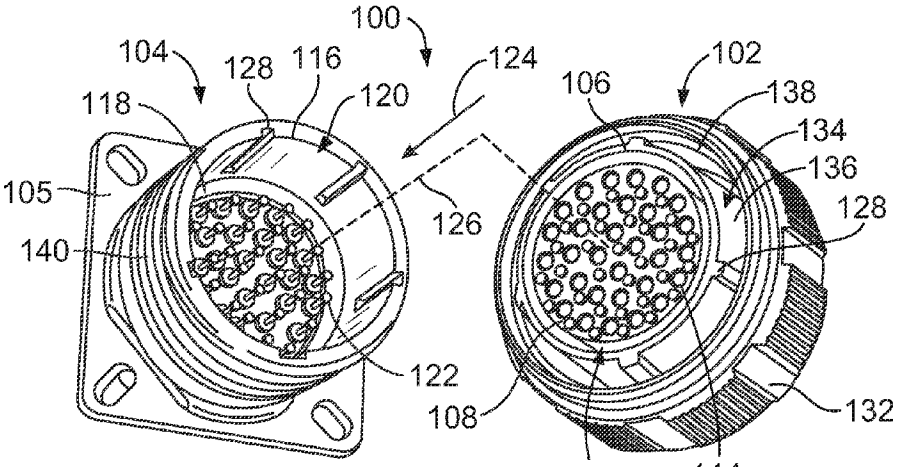
FIG. 1 is a perspective view of an electrical connector assembly according to an exemplary embodiment.

FIG. 1 is a perspective view of an electrical connector assembly 100 according to an exemplary embodiment. The connector assembly 100 includes a first electrical connector 102 and a second electrical connector 104 that is configured to be mated to the first electrical connector 102. In the illustrated embodiment, both connectors 102, 104 are circular connectors. For example, the first connector 102 is a circular plug connector, and the second connector 104 is a circular header connector. As used herein, the first connector 102 may be referred to as plug connector 102, and the second connector 104 may be referred to as header connector 104. The plug connector 102 may be defined as a mating connector 102 that mates with the electrical connector 104. The header connector 104 may be defined as a mating connector 104 that mates with the electrical connector 102. In the illustrated embodiment, the header connector 104 includes a mounting flange 105 at a distal end of the shell 116 thereof. The mounting flange 105 is configured to be mounted to a panel or chassis of a device (not shown). In other embodiments, the header connector 104 need not be mountable to a device.

The plug connector 102 includes a shell 106 that houses an insert assembly 108 within a chamber 110. The insert assembly 108 holds contacts 112 (shown in FIG. 2), which may be referred to herein as plug contacts 112, within cavities 114 that extend through the insert assembly 108. The header connector 104 includes a shell 116 that houses an insert assembly 118 within a chamber 120. Contacts 122, which may be referred to herein as header contacts 122, extend from the insert assembly 118. The plug contacts 112 of the plug connector 102 are configured for electrical connection to corresponding header contacts 122, which may be defined as mating contacts 122. Conversely, the header contacts 122 of the header connector 104 are configured for electrical connection to the plug contacts 112, which may be defined as mating contacts 112. In the illustrated embodiment, the header contacts 122 are pin contacts, and the plug contacts 112 are socket-type contacts configured to receive the pins during mating. In other embodiments, the header contacts 122 and plug contacts 112 may be other types of contacts.

The plug connector 102 is mated to the header connector 104 by moving the plug connector in a loading direction 124 along a mating axis 126 such that the shell 106 of the plug 102 is received within the chamber 120 defined by the shell 116 of the header 104. During loading, the header contacts 122 of the header 104 are each received in an individual cavity 114 of the plug 102 insert assembly 108 for electrical mating to a plug contact 112 (shown in FIG. 2) held within each cavity 114. Each of the shells 106, 116 may have keying features 128, such as ridges and/or grooves, so the shell 106 of the plug 102 is keyed to align with the shell 116 of the header 104 in a single orientation or a pre-defined set of orientations, to allow proper electrical transmission through the connectors 102, 104. For example, in the illustrated embodiment, the cavities 114 housing the plug contacts 112 are arranged in a circular array, and the header contacts 122 are arranged in a circular array, such that when the shells 106, 116 align during mating, the header contacts 122 align with and are received by the cavities 114 of the plug 102.

In an exemplary embodiment, the shell 106 of the plug connector 102 has a retention mechanism that is configured for coupling to the shell 116 of the header connector 104 upon mating to prevent the plug 102 from unintentionally disengaging the header 104. In the illustrated embodiment, the shell 106 of the plug 102 includes a coupling nut 132 that at least partially surrounds the shell 106, such as circumferentially surrounding the outer periphery 136 of the shell 106 for at least a portion of the axial length of the shell 106. The coupling nut 132 is rotatably mounted to the shell 106. The coupling nut 132 has a greater diameter than the shell 106, and defines a circumferential channel 134 between an outer periphery 136, or outer circumferential surface, of the shell 106 and an inner periphery 138, or inner surface, of the nut 132. The inner periphery 138 of the coupling nut 132 includes threads. At least a portion of an outer periphery 140, or outer surface, of the header shell 116 is also threaded. The threads of the coupling nut 132 are configured to be threaded to the shell 116 of the header connector 104.

During mating, the shell 116 of the header 104 is received in the circumferential channel 134 until the threads on header surface 140 contact the threads on inner nut surface 138. To complete and retain the mating connection between the header 104 and plug 102, the coupling nut 132 may be rotated to screw the nut 132 onto the header shell 116, which draws the plug 102 further onto the header 104 in the loading direction 124 along the mating axis 126. Alternatively, at least a portion of the shell 106, such as the outer periphery 136, includes threads, and the threads are configured to be threaded to the shell 116 of the header connector 104 without the use of a coupling nut. Furthermore, the coupling nut 132 may be rotatably mounted to the header connector 104 instead of the plug connector 102. In other embodiments, other retention mechanisms known in the art may be used in addition to or alternatively to a threaded coupling nut, such as deflectable or locking latches.

The connectors 102, 104 of the electrical connector assembly 100 may be designed to withstand harsh operating environments, such as extreme temperatures, extreme pressures, shock and vibration, corrosive contaminants, radiation, and/or electromagnetic interference. The connectors 102, 104 may be used in military and aerospace applications. Additionally, the connectors 102, 104 may be applied in industrial, marine, and automotive applications.

Figure 2:
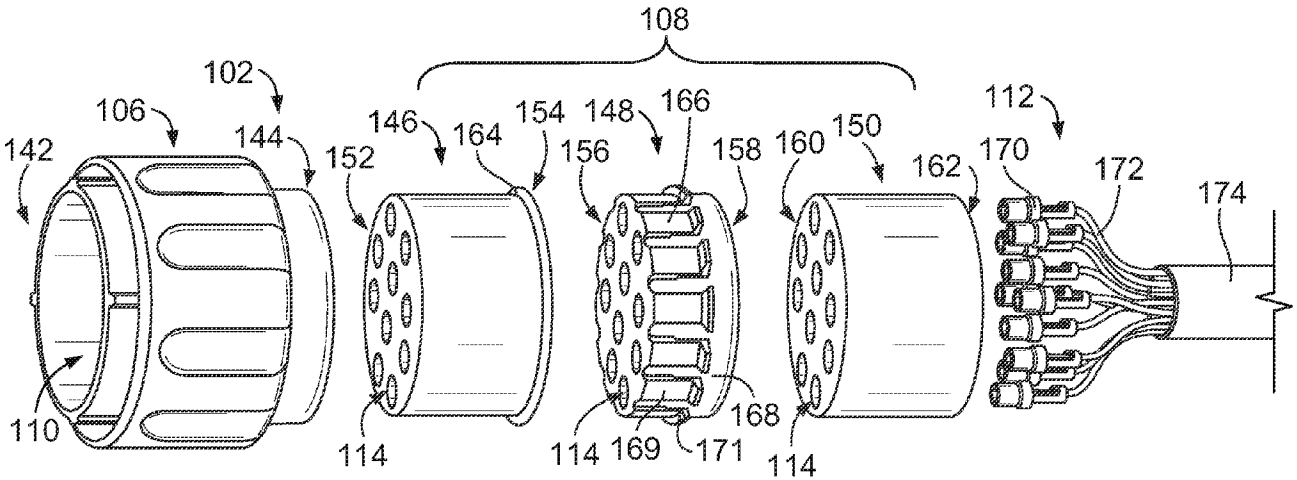
FIG. 2 illustrates an exploded electrical connector according to an exemplary embodiment.

FIG. 2 illustrates an exploded view of the electrical connector 102 according to an exemplary embodiment. While the plug connector 102 is illustrated and described in detail, it is realized that the header connector 104 (shown in FIG. 1) may include similar features. The plug connector 102 includes the shell 106, the insert assembly 108, and the plug contacts 112.

The shell 106 is formed of a metal or other conductive material. For example, the shell 106 may be die-cast aluminum. In the illustrated embodiment, the shell 106 is cylindrical with a mating end 142, a terminating end 144, and the chamber 110 extending through the shell 106 between the ends 142, 144. The insert assembly 108 is received in the chamber 110 and may be interchangeable with other insert assemblies 108 having different types or arrangements of contacts 112 to change the type of plug connector 102.

Figure 3:
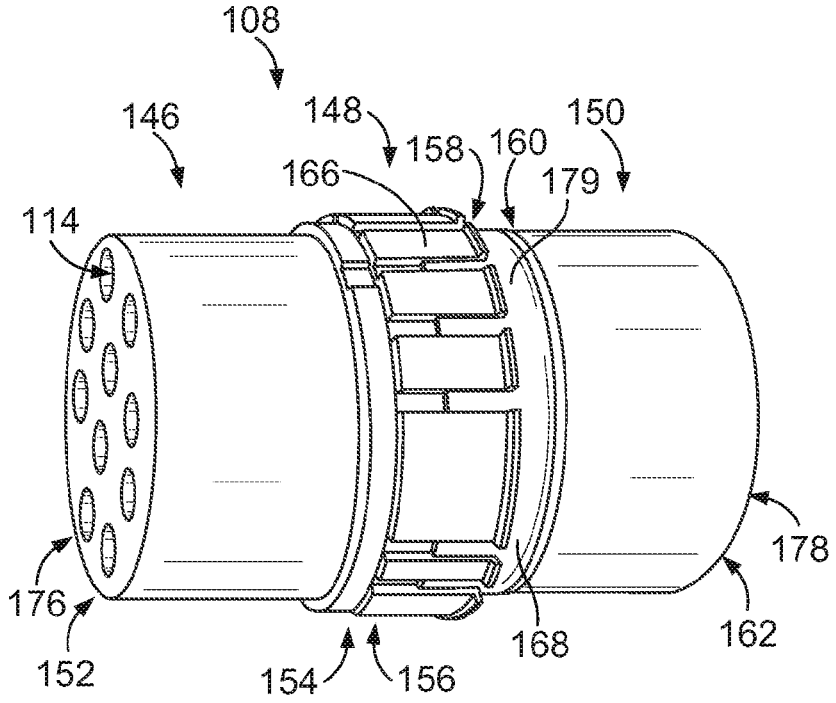
FIG. 3 is an assembled view of the insert assembly of the electrical connector shown in FIG. 2.

The insert assembly 108 includes a front insert 146, a rear insert 148, and a grommet 150. In an exemplary embodiment, the front insert 146, rear insert 148, and grommet 150 are all cylindrical, and are assembled end to end to form a cylindrical insert assembly 108 (as shown in FIG. 3). The front insert 146 includes a front side 152 and a rear side 154. The rear insert 148 has a front side 156 and a rear side 158. Likewise, the grommet 150 has a front side 160 and a rear side 162. The cavities 114 extend axially through each of the front insert 146, rear insert 148, and grommet 150 between the front sides 152, 156, 160 and the rear sides 154, 158, 162, respectively.

The front insert 146 may be a dielectric material, such as plastic, ceramic, rubber, and the like. The dielectric material may provide electrical insulation for the contacts 112 held in the cavities 114. The front insert 146 of the insert assembly 108, in an exemplary embodiment, includes a flange 164 that extends radially a short distance along a circumference of the front insert. The flange 164 may be integral to the front insert 146 (i.e., formed with the front insert 146 and not a separately added piece). The flange 164 is located proximate to the rear side 154 of the front insert 146. In other embodiments, however, the flange 164 may be located at any location along the axial length of the front insert 146.

The rear insert 148 may be a dielectric material. In an exemplary embodiment, the rear insert 148 is a molded plastic. The rear insert 148 includes resilient latches 166 that extend from an outer periphery 168 of the rear insert 148. The resilient latches 166 may be a resilient material that has spring properties so the latches 166 may deflect, such as a plastic material. In an exemplary embodiment, the resilient latches 166 are molded and formed integral with the rear insert 148 of the insert assembly 108.

In an exemplary embodiment, each latch 166 may emerge from the outer periphery 168 at or near the front side 156, while a free end 169 of the latch 166 extends generally towards the rear 158. The resilient latches 166 sit higher than the outer periphery 168 surface, so a radial gap 167 (shown in FIG. 4) is formed between the free ends 169 of the latches 166 and the outer periphery 168 surface. When under stress, the free ends 169 of the latches 166 deflect towards the outer periphery 168 surface, which minimizes the gap 167 until the stress is removed. Each resilient latch 166 has a raised edge 171 or lip at a distal end of the free end 169. The raised edge 171 extends radially outward. In the illustrated embodiment, the resilient latches 166 are spaced evenly around the outer periphery 168.

The grommet 150 may also be a dielectric material. In an exemplary embodiment, the grommet 150 is rubber. The rubber grommet 150 seals the plug contacts 112 housed within the cavities 114 of the insert assembly 108 from contaminants that could enter from the rear side 162 of the grommet 150. The grommet 150 may seal against wires 172 terminated to the contacts 112.

The plug contacts 112 may be stamped and formed from a conductive metal material. For example, the contacts 112 may be beryllium copper or phosphor-bronze and plated with gold or another non-corrosive, highly-conductive material. In the illustrated embodiment, the contacts 112 are socket-type contacts with mating ends 170 configured to receive and electrically connect to pins that define header contacts 122 of header connector 104 (both shown in FIG. 1). The contacts 112 terminate to wires 172 through either a solder connection or through crimping. The collection of wires 172 are grouped within an insulated cable 174. The wires 172 carry the electrical transmission through the cable 174 to a device (not shown).

FIG. 3 is an assembled view of the insert assembly 108 of the electrical connector 102 (shown in FIG. 2). The insert assembly 108 is assembled by connecting the rear side 154 of the front insert 146 to the front side 156 of the rear insert 148 and connecting the rear side 158 of the rear insert 148 to the front side 160 of the grommet 150. Thus, the rear insert 148 is located between the front insert 146 and the grommet 150. Each of the connections may be made by bonding the sides together. For example, the grommet 150 may be bonded to the rear insert 148, and the rear insert 148 may be bonded to the front insert 146. Alternatively, or in addition, mechanical mechanisms may be used to connect the front insert 146 to the rear insert 148 and/or the rear insert 148 to the grommet 150. During assembly, the front insert 146, rear insert 148, and grommet 150 are aligned such that each cavity 114 extends uninterrupted from the front insert 146 to the grommet 150. The cavities 114 are aligned to ensure proper electrical contact is made between the plug contacts 112 (shown in FIG. 2) and the header/receptacle contacts 122 (shown in FIG. 1) within the cavities 114 during mating.

In an exemplary embodiment, the assembled insert assembly 108 is cylindrical and includes a front 176 and a rear 178. The front 176 is the front side 152 of the front insert 146. The rear 178 is the rear side 162 of the grommet 150. The resilient latches 166 extend from an outer periphery 179, or outer surface, of the insert assembly 108. More specifically, the latches 166 extend from the outer periphery 168 of the rear insert 148. The resilient latches 166 engage the shell 106 (shown in FIG. 2) to hold the insert assembly 108 in the chamber 110 (shown in FIG. 2).

Figure 4:
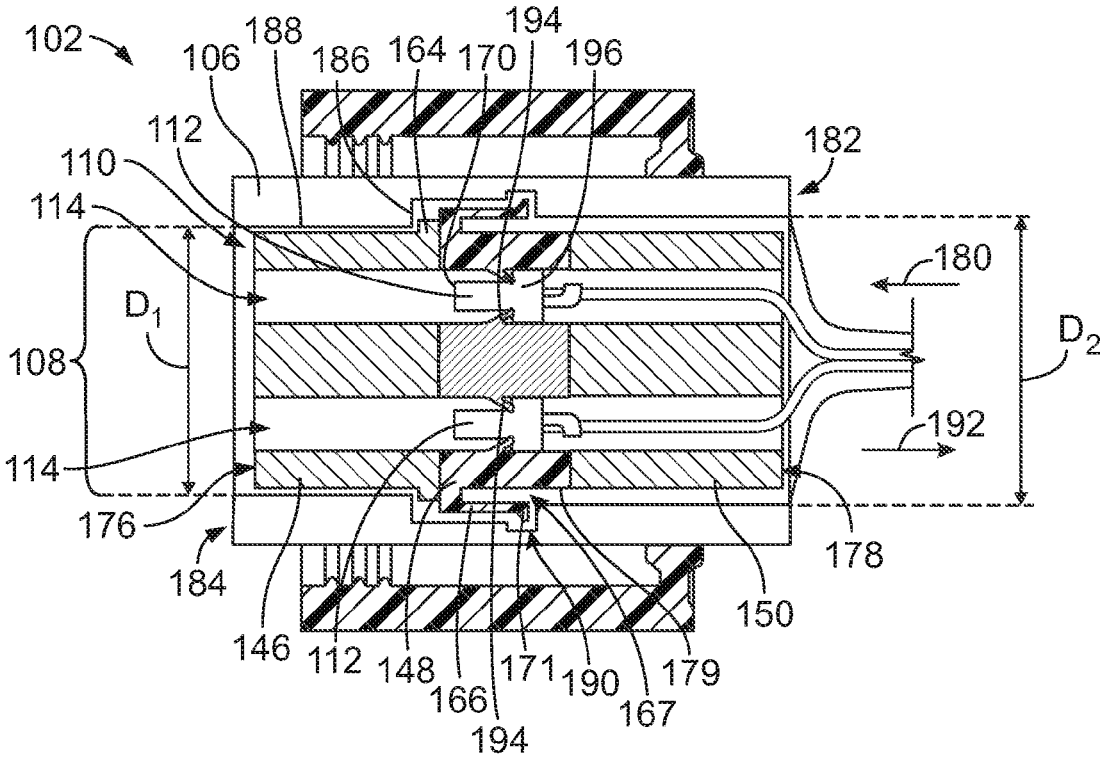
FIG. 4 is a cross-sectional view of the electrical connector shown in FIG. 2.

FIG. 4 is a cross-sectional view of the electrical connector 102. In an exemplary embodiment, the insert assembly 108 is loaded into the chamber 110 of the plug shell 106 in a loading direction 180 from a rear 182 of the shell 106 towards the front 184. The shell 106 has a shoulder 186 along an inner periphery 188, or inner circumferential surface, of the shell 106. The shoulder 186 is a step that changes the diameter of the chamber 110. As shown in FIG. 4, the diameter of the chamber D1 from the shoulder 186 to the front 184 of the shell 106 is less than the diameter of the chamber D2 at the rear 182 of the shell 106. The insert assembly 108 is loaded into the chamber 110 in the loading direction 180 until the flange 164 abuts the shoulder 186 of the shell 106, which prevents additional movement of the insert assembly 108 in the loading direction 180 relative to the shell 106.

In an exemplary embodiment, the inner periphery 188 of the shell 106 defines a groove 190, which is a recess that extends circumferentially along the inner periphery 188. The groove 190 is located rearward of the shoulder 186. The groove 190 may be continuous along the entire circumference of the inner periphery 188. Alternatively, the groove 190 may be segmented into multiple pockets (not shown) positioned along the inner periphery 188 of the shell 106.

When loading the insert assembly 108 into the shell 106, the resilient latches 166 deflect radially inward towards the outer periphery 179 of the insert assembly 108 as the raised edges 171 get pinched by the inner periphery 188 walls of the shell 106 that define the chamber 110. Once the raised edges 171 reach the groove 190, the stress applied by the inner periphery 188 walls is removed, so the biased resilient latches 166 straighten. Upon straightening, the raised edges 171 extend into the groove 190. In other words, the resilient latches 166 are biased towards being received in the groove 190. In the alternate embodiment where the groove 190 is segmented into pockets, each pocket may be dimensionally configured to receive at least one resilient latch 166. Segmenting the groove 190 into pockets may provide retention forces to prevent the insert assembly 108 from rotating relative to the shell 106 once loaded.

The resilient latches 166 prohibit unintentional disengagement of the insert assembly 108 from the shell 106 in an unloading direction 192. In the illustrated embodiment, a force on the insert assembly 108 in the unloading direction 192 causes the raised edges 171 to abut a rear wall of the groove 190 which provides a counterforce in the loading direction 180. Therefore, in an exemplary embodiment, the insert assembly 108 is retained in the chamber 110 of the shell 106 by mechanical connections between the shoulder 186 and the flange 164 (which prevents additional movement in the loading direction 180) and between the rear wall of the groove 190 and the raised edges 171 (which prevents unintentional movement in the unloading direction 192). Optionally, the amount of force required to unload may be adjusted by changing the dimensions, angles, and materials of abutting retention components (e.g., shoulder 186, flange 164, rear wall of groove 190, and raised edges 171). The latches 166 allow the insert assembly 108 to be simply plugged into the shell 106 and retained therein without the need for other retaining components, such as snap rings or clips.

Optionally, after the insert assembly 108 is received in the chamber 110 of the shell 106, a potting component (not shown) may be placed in the gap 167 between the resilient latches 166 and the outer periphery 179 of the insert assembly 108. The potting component fills the gap 167 and prevents the resilient latches 166 from deflecting and disengaging the shell 106. The potting component effectively locks the insert assembly 108 into the shell 106, since the latches 166 must deflect to allow the raised edges 171 to move in the unloading direction 192 past the rear wall of the groove 190 for the insert assembly 108 to be removed through the rear 182 of the shell 106.

The plug contacts 112 are held in the cavities 114 and oriented with the mating end 170 facing the front 176 of the insert assembly 108 to receive header contacts 122 (shown in FIG. 1) of header connector 104 (shown in FIG. 1). In an exemplary embodiment, each plug contact 112 may be inserted into a respective cavity 114 from the rear 178 of the insert assembly, prior to or after the insert assembly 108 is loaded into the shell 106. Within the cavities 114, the plug contacts 112 are held in place by retention fingers 194. The retention fingers 194 are deflectable extensions within the cavities 114 of the insert assembly 108 that are configured for retaining the contacts 112 within the cavities 114. The retention fingers 194 may retain the contacts 112 by an interference fit. The retention fingers 194 may be similar in form and function to the resilient latches 166.

The contacts 112 optionally may be formed with a base 196 that has a greater diameter than the mating end 170, such that upon loading each contact 112 into the cavity 114, the base 196 abuts the retention fingers 194 (as shown in FIG. 4) to prevent further movement of the contact 112 in the loading direction 180. Additionally, the contacts 112 may optionally be formed with a groove (not shown) along the mating end 170. The groove is configured to receive the retention fingers 194 to prevent unintentional movement of the contacts 112 in the unloading direction 192 (similar to the groove 190 of the shell 106). In the illustrated embodiment, each cavity 114 includes at least two retention fingers 194. In another embodiment, however, each cavity 144 may have one retention finger 194 that holds the contact 112 by an interference fit by squeezing the contact 112 against a wall of the cavity 114. The retention fingers 194 are configured to retain pin-type contacts as well as socket-type contacts.

In an exemplary embodiment, the retention fingers 194 are within the cavities 114 defined by the rear insert 148 portion of the insert assembly 108. The retention fingers 194 may be plastic and molded integrally with the formation of the rear insert 148 (like the resilient latches 166). Since the resilient latches 166 and retention fingers 194 are integrally molded with the rear insert 148, no supplemental devices need to be added during loading of the insert assembly 108 into the shell 106 and loading of the contacts 112 into the insert assembly 108. In other embodiments, the front insert 146 and/or grommet 150 may house contact retention mechanisms within the cavities 114 instead of, or in addition to, the retention fingers 194 within the rear insert 148.

Figure 5:
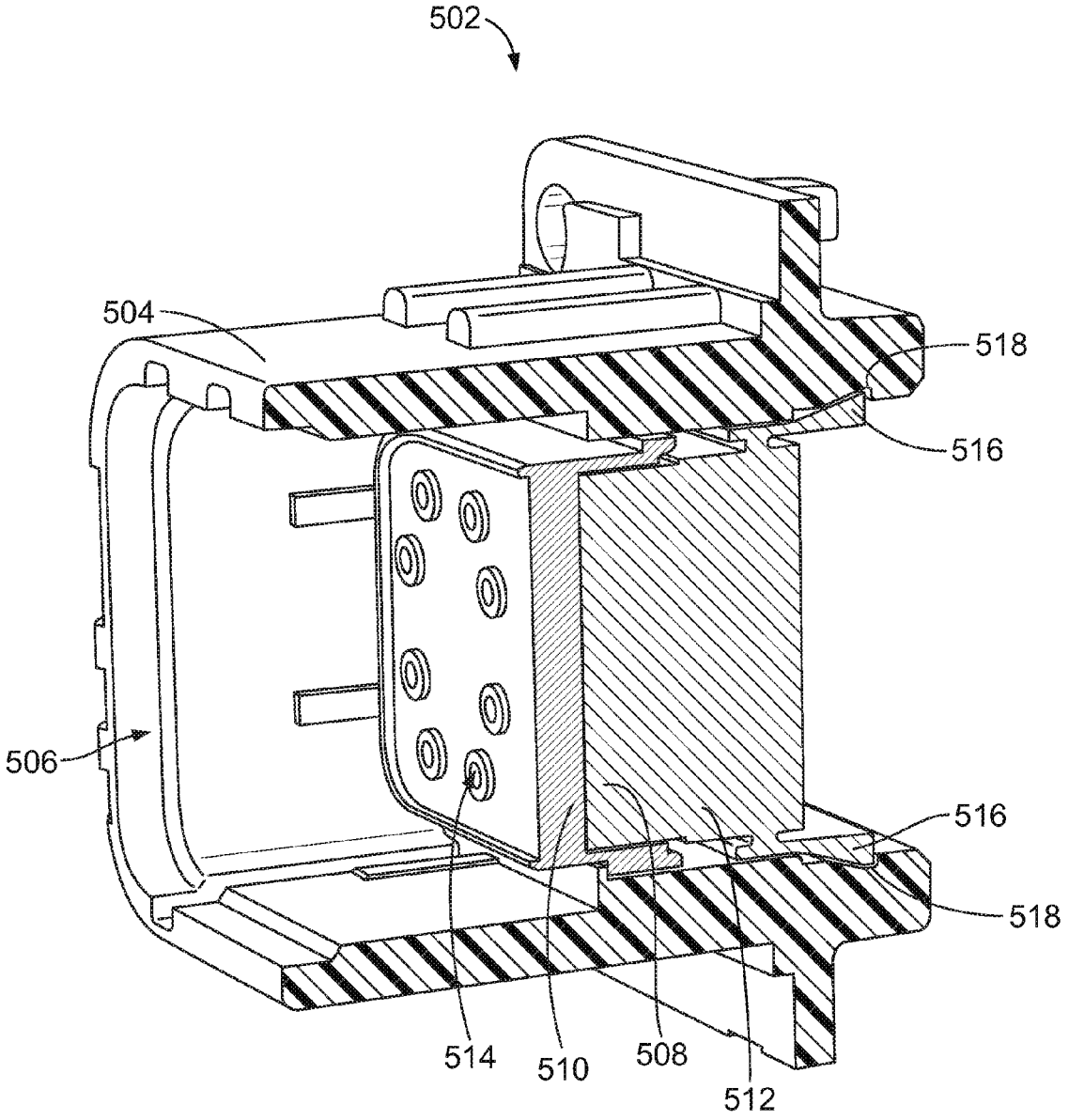
FIG. 5 is a perspective cross-sectional view of an electrical connector according to another embodiment.

FIG. 5 is a perspective cross-sectional view of an electrical connector 502 according to another embodiment. The electrical connector 502 may be similar to the electrical connector 102 (shown in FIG. 1). The connector 502 includes a shell 504 with a chamber 506 therein, and the chamber 506 housing an insert assembly 508. The insert assembly 508 may include a front insert 510, a rear insert 512, and a grommet (not shown). The insert assembly 508 includes cavities 514 that are configured to receive and hold contacts (not shown) therein for electrically connecting with mating contacts of a mating connector (not shown).

As shown in FIG. 5, the electrical connector 502 may have a rectangular or square profile, as opposed to the circular profile of connector 102 (shown in FIG. 1). By "rectangular or square profile," the electrical connector 502 may have a rectangular prism shape with a rectangular or square cross-section (instead of having a generally cylindrical shape with a circular cross-section). Therefore, the shell 504 may have multiple sides, such as a top side, a bottom side, a left side, and a right side, and the chamber 506 defined by the shell 504 may be rectangular or square-shaped as well. Likewise, the insert assembly 508 may have multiple sides, such as a top side, a bottom side, a left side, and a right side. Corners adjoining two adjacent sides of the shell 504 and/or insert assembly 508 may be curved. Alternatively, the electrical connector 502 may have a polygonal profile other than rectangular or square, such as triangular, trapezoidal, pentagonal, or hexagonal.

The insert assembly 508 includes multiple resilient latches 516, which may be configured similarly to the resilient latches 166 (shown in FIG. 3). The resilient latches 516 are biased towards being received in a groove 518 in the shell 504 within the chamber 506. The groove 518 may extend at least partially along an inner wall of at least one of the sides of the shell 504. In an exemplary embodiment, the groove 518 extends along at least two opposite sides. Upon loading the insert assembly 508 into the chamber 506, the resilient latches 516 deflect inwards until the latches 516 are received in the groove 518. A rear wall of the groove 518 interferes with the resilient latches 516 to prevent undesired movement and disengagement of the insert assembly 508 from the shell 504. The resilient latches 516, therefore, may be used with the rectangular electrical connector 502, and other connectors having different shapes, where traditional retention mechanisms, such as snap rings and screw-in retaining devices, may not be available.

Referring back to FIG. 1, in an exemplary embodiment, the insert assembly 118 of the header connector 104 includes similar components as the plug connector 102, such as a front insert, a rear insert, and a grommet that are bonded together in that order to form the insert assembly 118 in a cylindrical shape. The rear insert includes integrally molded resilient latches that extend from an outer periphery of the insert assembly 118. When the insert assembly 118 is received in the shell 116, the resilient latches engage the shell 116 to hold the insert assembly 118 in the chamber 120 of the shell 116. An inner periphery of the shell 116 may include a groove that is configured to receive the resilient latches. Walls defining the groove may provide retention forces against the resilient latches to prevent the insert assembly 118 from disengaging the shell 116 unintentionally. Optionally, the inner periphery of the shell 116 may define a shoulder that abuts a flange on the insert assembly 118 during loading to prevent the insert assembly 118 from additional movement in a loading direction relative to the shell 116. The insert assembly 118 includes multiple cavities that are configured to hold and (at least partially) house the header contacts 122. The header contacts 122 are retained in the cavities by retention fingers that extend from walls defining the cavities. The retention fingers may be integrally molded with the rear insert.

At least one embodiment provides the technical effect of avoiding the need for secondary retention devices to retain an insert assembly within a shell in an electrical connector. Issues associated with secondary retention devices, such as additional parts costs, additional costs of labor and special tooling to install the device, and potential dislodging of the insert assembly due to improper seating or insertion process variations, are avoided.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a shell with a chamber and an insert assembly received in the chamber, the chamber having an enclosed groove along an inner periphery of the shell, the groove being only accessible from within the chamber and sealed from the exterior of the electrical connector by the shell;

the insert assembly having cavities therethrough configured to receive contacts, the contacts configured for electrical connection to mating contacts of a mating connector, the insert assembly having resilient latches extending from an outer periphery of the insert assembly that are received in the groove and engage the shell to hold the insert assembly in the chamber, the resilient latches being enclosed by the shell.

2. The electrical connector of claim 1, wherein the resilient latches circumferentially surround the insert assembly, the resilient latches biased towards being received in the groove.

3. The electrical connector of claim 1, wherein the groove comprises multiple pockets positioned along the inner periphery of the shell, each pocket configured to receive at least one resilient latch.

4. The electrical connector of claim 1, wherein the shell is conductive and the insert assembly is dielectric, the resilient latches are molded and formed integral with the insert assembly.

5. The electrical connector of claim 1, wherein the insert assembly further comprises a flange and the shell has a shoulder along an inner periphery of the shell, the insert assembly is loaded into the chamber of the shell in a loading direction until the flange of the insert assembly abuts the shoulder of the shell to prevent addition movement of the insert assembly in the loading direction relative to the shell.

6. The electrical connector of claim 1, wherein the insert assembly comprises a front insert, a rear insert, and a grommet, wherein the rear insert is between the front insert and the grommet, and the resilient latches extend from an outer periphery of the rear insert.

7. The electrical connector of claim 6, wherein the grommet is bonded to the rear insert, and the rear insert is bonded to the front insert.

8. The electrical connector of claim 1, wherein the shell further comprises a mounting flange at a distal end thereof configured to be mounted to a panel of a device.

9. The electrical connector of claim 1, wherein the shell further comprises a retention mechanism configured for coupling to a shell of a mating connector.

10. The electrical connector of claim 1, wherein the chamber of the shell and the insert assembly have a rectangular profile.

11. The electrical connector of claim 1 further comprising a coupling nut rotatably mounted to the shell, the coupling nut at least partially surrounding the shell, the coupling nut having an inner periphery including threads, the threads configured to be threaded to a shell of a mating connector.

12. The electrical connector of claim 1, wherein the cavities of the insert assembly have retention fingers therein configured for retaining the contacts within the cavities.

13. The electrical connector of claim 1, wherein the contacts are socket contacts that terminate to wires, the socket contacts configured to receive and electrically connect to pins comprising the mating contacts of the mating connector.

14. The electrical connector of claim 1, wherein, after the insert assembly is received in the chamber of the shell, a potting component is placed in a gap between the resilient latches and the outer periphery of the insert assembly to prevent the resilient latches from deflecting and disengaging the shell.

15. An electrical connector comprising:

a shell with a chamber and an insert assembly received in the chamber, the chamber having an enclosed groove along an inner periphery of the shell, the groove being only accessible from within the chamber and sealed from the exterior of the electrical connector by the shell;

the insert assembly comprising a front insert and a rear insert, the front insert and rear insert having cavities therethrough configured to receive contacts, the contacts configured for electrical connection to mating contacts of a mating connector, the rear insert having resilient latches extending from an outer periphery of the rear insert that are received in the groove and engage the shell to hold the insert assembly in the chamber, the resilient latches being enclosed by the shell.

16. The electrical connector of claim 15, wherein the front insert is bonded to the rear insert.

17. The electrical connector of claim 15, wherein the resilient latches are molded and formed integral with the rear insert.

18. The electrical connector of claim 15, wherein an inner periphery of the shell comprises a shoulder and a groove, the shoulder abuts a flange on the front insert to prevent excessive movement of the insert assembly in a loading direction relative to the shell, the groove receives the resilient latches to prohibit undesired movement of the insert assembly in an unloading direction relative to the shell.

19. An electrical connector assembly comprising:

a first electrical connector and a second electrical connector configured to be mated to the first electrical connector, the first electrical connector and the second electrical connector each having a shell with a chamber and an insert assembly received in the chamber, the chamber of the first electrical connector having an enclosed groove along an inner periphery of the shell, the groove being only accessible from within the chamber and sealed from the exterior of the electrical connector by the shell, the insert assembly of the first electrical connector comprising a front insert bonded to a rear insert, the front and rear inserts having cavities therethrough configured to receive first contacts, the first contacts configured for electrical connection to second contacts held by the insert assembly of the second electrical connector, the rear insert of the first electrical connector having integrally-molded resilient latches extending from an outer periphery of the rear insert that are received in the groove and engage the shell of the first electrical connector to hold the insert assembly of the first electrical connector within the chamber of the shell, the resilient latches being enclosed by the shell.

20. The electrical connector assembly of claim 19, wherein the shell of the first electrical connector is keyed to align with the shell of the second electrical connector in a single orientation.

* * * * *